US010335917B2

(12) United States Patent
Sato

(10) Patent No.: US 10,335,917 B2
(45) Date of Patent: Jul. 2, 2019

(54) PAD FOR SUPPORTING ABRASIVE DISC

(71) Applicant: 3M INNOVATIVE PROPERTIES COMPANY, St. Paul, MN (US)

(72) Inventor: Tsukio Sato, Tokyo (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 14/781,138

(22) PCT Filed: Mar. 28, 2014

(86) PCT No.: PCT/US2014/032102

§ 371 (c)(1),
(2) Date: Sep. 29, 2015

(87) PCT Pub. No.: WO2014/165394

PCT Pub. Date: Oct. 9, 2014

(65) Prior Publication Data

US 2016/0052102 A1 Feb. 25, 2016

(30) Foreign Application Priority Data

Apr. 4, 2013 (JP) ..... 2013-078644

(51) Int. Cl.

| | |
|---|---|
| ***B24B 23/04*** | (2006.01) |
| ***B24B 23/02*** | (2006.01) |
| ***B24B 23/00*** | (2006.01) |
| ***B24D 9/08*** | (2006.01) |

(52) U.S. Cl.

CPC ..... *B24B 23/02* (2013.01); *B24B 23/005* (2013.01); *B24B 23/028* (2013.01); *B24D 9/08* (2013.01)

(58) Field of Classification Search

CPC ..... B24D 9/08; B24B 23/04; B24B 23/028
USPC ..... 451/359, 508, 509
See application file for complete search history.

(56) References Cited

U.S. PATENT DOCUMENTS

| | | | | |
|---|---|---|---|---|
| 1,778,470 | A * | 10/1930 | Stratford | B24D 9/08 451/359 |
| 2,606,947 | A * | 8/1952 | Happe | F16C 27/066 310/406 |
| 6,066,034 | A | 5/2000 | Hettes | |
| 6,523,214 | B1 * | 2/2003 | Kaiser | B24B 23/022 15/180 |
| 6,758,732 | B1 * | 7/2004 | Hilton | B24B 23/028 451/177 |
| 6,863,596 | B2 * | 3/2005 | Fritz | B24D 13/20 451/342 |

(Continued)

FOREIGN PATENT DOCUMENTS

| | | |
|---|---|---|
| CA | 1 172 854 | 8/1984 |
| EP | 0 397 624 | 11/1990 |

(Continued)

*Primary Examiner* — Robert A Rose
(74) *Attorney, Agent, or Firm* — Aleksander Medved

(57) ABSTRACT

A pad for supporting an abrasive disc by being fixed with the abrasive disc to a shaft of a grinder, the pad including a supporting surface opposing the abrasive disc. In a radial direction, an outer edge of the supporting surface is located inward of an outer edge of the abrasive disc. The supporting surface includes a taper portion inclined away from the abrasive disc as it approaches the outer edge of the supporting surface. The abrasive disc is not fixed to the taper portion.

13 Claims, 11 Drawing Sheets

(56) References Cited

U.S. PATENT DOCUMENTS

| | | | | |
|---|---|---|---|---|
| 7,021,995 | B2 | 4/2006 | Toge | |
| 7,223,165 | B2 | 5/2007 | Wuensch | |
| 2003/0166385 | A1 | 9/2003 | Nelson | |
| 2004/0127151 | A1 | 7/2004 | Takizawa et al. | |
| 2004/0203330 | A1 | 10/2004 | Kleider | |
| 2005/0233681 | A1* | 10/2005 | Jost | B23Q 11/0046 451/49 |
| 2008/0057842 | A1* | 3/2008 | Lampka | B24B 23/022 451/357 |
| 2010/0062695 | A1 | 3/2010 | Roehm | |
| 2010/0159813 | A1* | 6/2010 | Pajovic | B24D 13/16 451/548 |
| 2011/0045749 | A1* | 2/2011 | Harris | A47L 11/1625 451/359 |
| 2011/0045750 | A1* | 2/2011 | Stuckenholz | B24D 7/04 451/359 |
| 2011/0212674 | A1 | 9/2011 | Ficai | |
| 2012/0071073 | A1 | 3/2012 | Farber | |
| 2014/0179205 | A1* | 6/2014 | Chen | B24D 18/0009 451/490 |
| 2015/0251295 | A1* | 9/2015 | Chen | B24D 9/08 451/509 |

FOREIGN PATENT DOCUMENTS

| | | |
|---|---|---|
| GB | 666035 | 8/1949 |
| JP | S57-34361 | 2/1982 |
| JP | S57-157456 | 10/1982 |
| JP | S59-163452 | 9/1984 |
| JP | 2003-513811 | 4/2003 |
| JP | 2005-342837 | 12/2005 |
| JP | 2012-006099 | 1/2012 |
| KR | 20-0193826 | 8/2000 |
| WO | WO 2001/36160 | 3/2001 |
| WO | WO 2005/061176 | 7/2005 |

* cited by examiner

PAD FOR SUPPORTING ABRASIVE DISC

CROSS REFERENCE TO RELATED APPLICATIONS

This application is a national stage filing under 35 U.S.C. 371 of PCT/US2014/032102, filed Mar. 28, 2014, which claims priority to Japanese Patent Application No. 2013-078644, filed Apr. 4, 2013, the disclosures of which are incorporated by reference in their entirety herein.

FIELD OF INVENTION

A first aspect of the present invention relates to a pad for supporting an abrasive disc.

BACKGROUND

Various types of grinder are known in the prior art, one of which is the portable grinder. The grinder described in Patent Document 1 below includes a support plate and fiber grinding disc, the disc being adhered to the support plate.

Patent Document 1: Specification of U.S. Published Application No. 2011/0045750

SUMMARY

However, with the grinders, such as the one described in Patent Document 1, the amount of abrasion with a single abrasive disc is limited, and the user was required to replace the abrasive disc after a short period. A way of increasing the amount of abrasion with a single abrasive disc is therefore desired.

A pad according to a first aspect of the present invention is a pad for supporting an abrasive disc by being fixed with the abrasive disc to a shaft of a grinder, the pad comprising a supporting surface opposing the abrasive disc, wherein, in a radial direction, an outer edge of the supporting surface is located inward of an outer edge of the abrasive disc, and the supporting surface includes a taper portion inclined away from the abrasive disc as it approaches the outer edge of the supporting surface, and the abrasive disc is not fixed to the taper portion.

In such an aspect, the abrasive disc edge portion that projects beyond the supporting surface is not supported by the pad, and so the protruding edge portion can be contacted against a grinding target in a flexible manner. In addition, the supporting surface of the pad has the taper portion inclining in the manner described above toward the outer edge, and the abrasive disc separates from the pad over the taper portion. Hence, an area of the abrasive disc supported by the taper portion can be contacted against the grinding target in a flexible manner. Thus, the area of the abrasive disc supported by the taper portion and the edge portion can be effectively used for grinding and, consequently, the amount of abrasion with a single abrasive disc can be further increased.

Effect of the Invention

According to the first aspect of the present invention, the amount of abrasion with a single abrasive disc can be further increased.

DETAILED DESCRIPTION

An embodiment of the present invention is described below in detail while referring to the accompanying drawings. Note that in the descriptions of the drawings, similar or identical components are assigned identical reference numbers and duplicate descriptions thereof are omitted.

A construction of a pad (back-up pad) 10 according to the embodiment is described below with reference to FIGS. 1 to 6.

Figure 1:
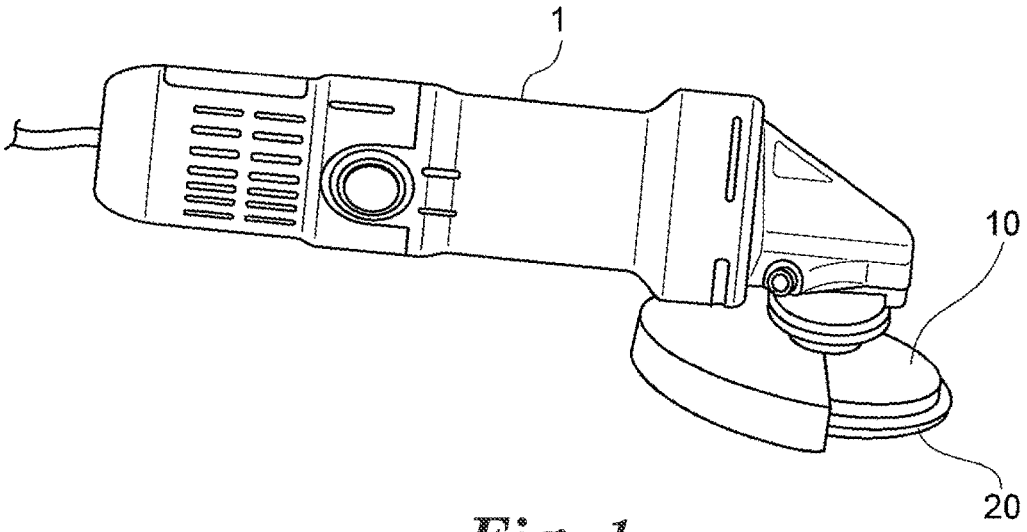
FIG. 1 is an external view of a portable grinder including a pad according to an embodiment.

The pad 10 is a part for supporting an abrasive disc 20 installed on a portable grinder 1 illustrated in FIG. 1. A hard resin material such as a nylon is selected here as the material for the pad 10 due to heat resistance, but the material of the pad 10 is not limited thereto.

The abrasive disc 20 is a disc-form abrasive tool used by installing on the portable grinder 1 and driving to rotate. The abrasive disc 20 is obtained by uniformly adhering grains or fine particles of an abrasive material on surfaces of a flexible base material such as cotton fabrics or paper using an adhesive such as a glue, a gelatin, and a composite resin. Hence, the abrasive disc 20 has a certain level of flexibility. It is preferable that the base material of the abrasive disc 20 is formed from a reinforced fiber and is heat resistant.

Figure 2:
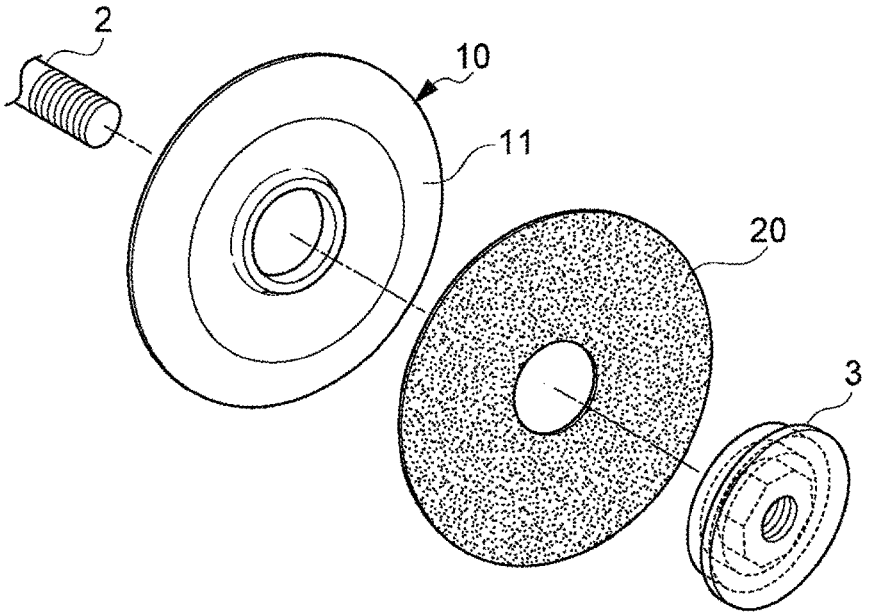
FIG. 2 is an exploded perspective view for describing installation of the pad according to the embodiment.

The pad 10 and the abrasive disc 20 are detachably installed on the main body of the portable grinder 1. As illustrated in FIG. 2, the user first installs the pad 10 on a shaft 2 extending from the main body of the portable grinder 1, and then installs the abrasive disc 20. The user then fixes the pad 10 and the abrasive disc 20 to the shaft 2 by attaching and tightening a nut 3 on a male thread formed on an end portion of the shaft 2. A surface of the pad 10 opposing the abrasive disc 20 functions as a supporting surface 11 that supports the abrasive disc 20 during grinding.

When the user operates the portable grinder 1, the pad 10 and the abrasive disc 20 rotate at high speed with the shaft 2 as an axis of rotation. A surface of the grinding target can be ground by the user causing the abrasive disc 20 to contact the surface. Note that in this specification, the term "grinding" is the concept intended to include "polishing".

When the grinding capability of the abrasive disc 20 has dropped, the user simply removes the nut 3 from the shaft 2, replace the abrasive disc 20 with a new one, and reattaches the nut 3 to the shaft 2. Note, however, that the pad 10 can be reused, and the user does not need to replace the pad 10 with the abrasive disc 20 every time. Note also that the pad 10 may be provided so as to be fixed to the shaft 2.

Figure 3:
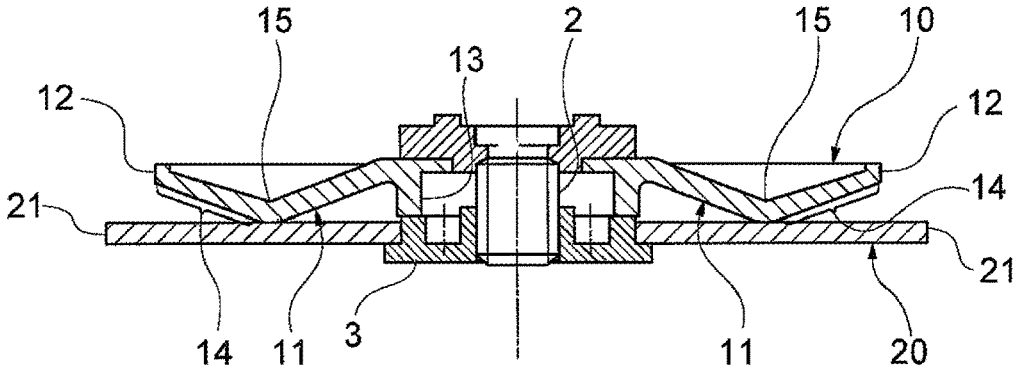
FIG. 3 is a cross-sectional view illustrating a state of the pad of the embodiment being fixed to a shaft.

FIG. 3 illustrates a state in which the pad 10 and the abrasive disc 20 are fixed to the shaft 2. As illustrated in this cross-sectional view, an outer edge 12 of the pad 10 (or supporting surface 11) is positioned inward of an outer edge 21 of the abrasive disc 20, in a direction orthogonal to an axial direction of the shaft. In other words, an edge portion of the abrasive disc 20 protrudes outward from the pad 10.

As illustrated in FIG. 3, the supporting surface 11 of the pad 10, which opposes the abrasive disc 20, is not flat. Rather, the cross-section along a radial direction has a V-shape (a flattened V-shape, for example). Specifically, the supporting surface 11 inclines toward the abrasive disc 20 from an inner wall forming a through hole 13 for the shaft 2 to an outer edge 12, and subsequently inclines away from the abrasive disc 20. In this specification, a portion that inclines away from the abrasive disc 20 as it approaches the outer edge 12 of the supporting surface 11 is referred to as a taper portion 14. Further, a portion corresponding to vertex of the V-shaped cross-sectional profile and always contacting the abrasive disc 20 is referred to as a vertex portion 15. By creating the V-shaped cross-sectional profile along the radial direction of the pad 10 in this manner, stiffness of the pad 10 is increased, allowing the abrasive disc 20 to be reliably supported.

In the taper portion 14, a curve (R) protruding toward the abrasive disc 20 side may be formed from the vertex portion 15 to the outer edge 12. A curvature radius of the curve may be freely set. For example, when the radius of the abrasive disc 20 is from 80 to 120 mm, the upper and lower limits on the curvature radius may be 80 mm and 120 mm, respectively. By providing the curve, an area of the abrasive disc 20 supported by the taper portion 14 (referred to hereinafter as area Ay) can be caused to make a point contact with the grinding target. Hence, it is possible to use this area to grind precisely.

The abrasive disc 20 is not fixed to the supporting surface 11. Accordingly, when the portable grinder 1 is not being operated, the abrasive disc 20 contacts the supporting surface 11 only in proximity to the vertex portion 15 while other portions are separated from the supporting surface 11.

Figure 4:
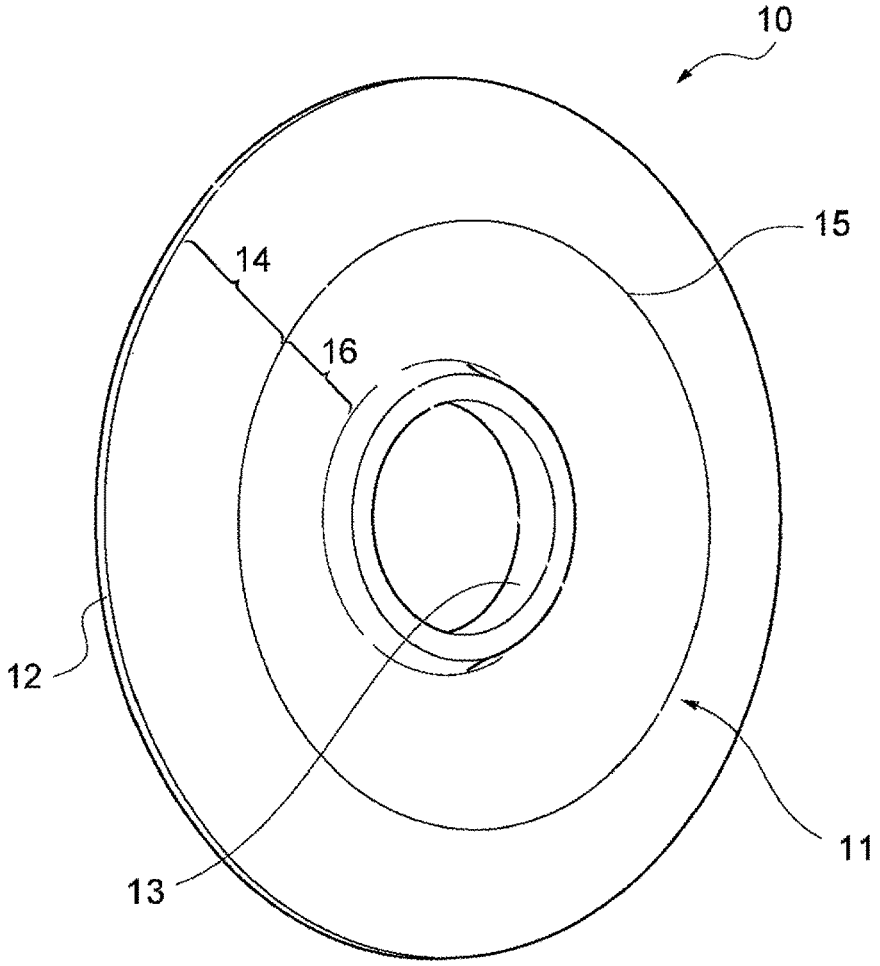
FIG. 4 is a perspective view illustrating a front surface of the pad according to the embodiment.
Figure 5:
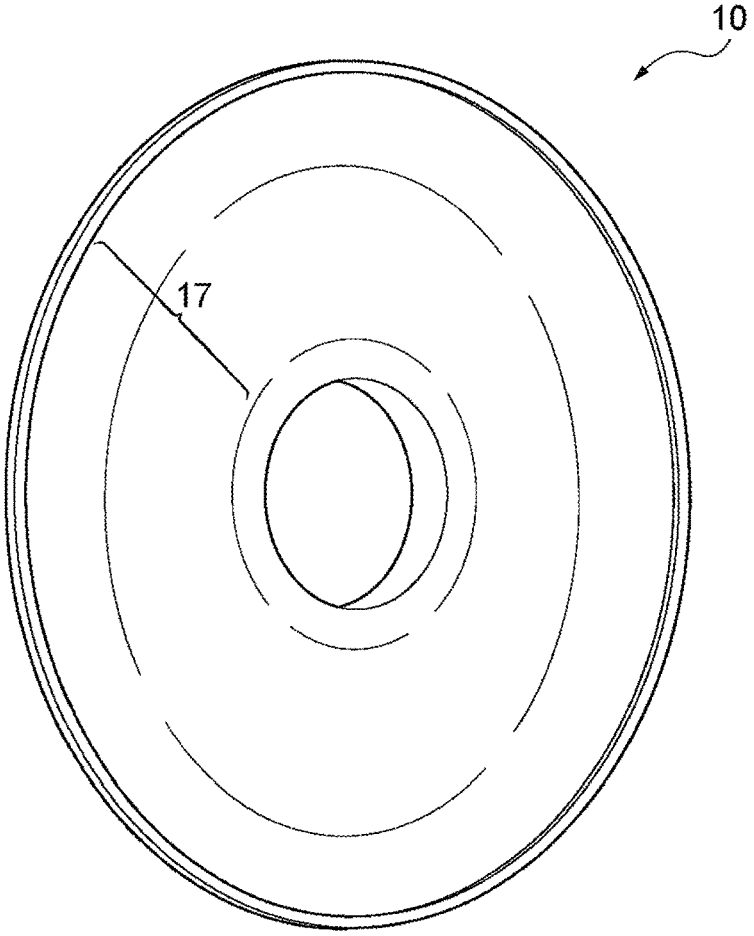
FIG. 5 is a perspective view illustrating a rear surface of the pad according to the embodiment.

Since the cross-section of the pad 10 is formed as described above, when the pad 10 is viewed from the front (supporting surface 11) as illustrated in FIG. 4, a depression 16 is formed around an entire circumference in an area extending from the through hole 13 to the vertex portion 15. The taper portion 14 is also formed around the entire circumference in an area extending from the vertex portion 15 to the outer edge 12. On the other hand, the rear surface (surface on a side opposite the supporting surface 11) of the pad 10 illustrated in FIG. 5 has formed therein around the entire circumference a recessed portion 17 with a gentle V-shaped form whose bottom is formed by a back side of the vertex portion 15.

Figure 6:
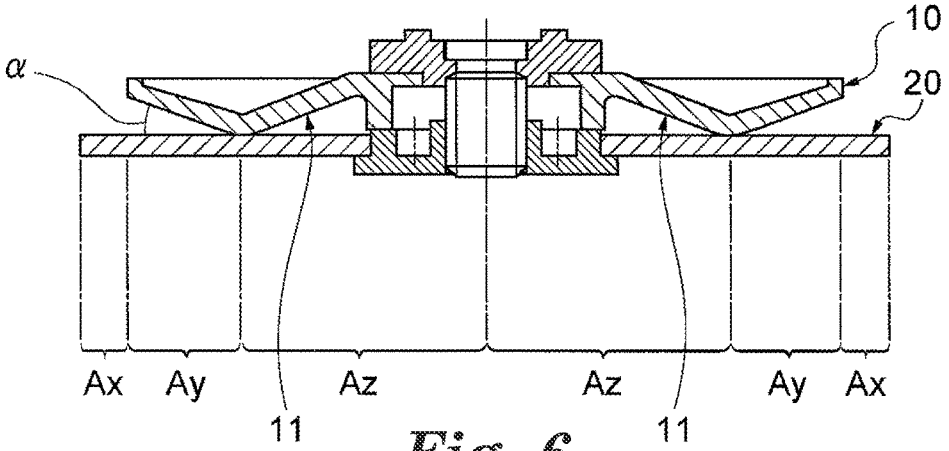
FIG. 6 is a view for describing a usable area of the abrasive disc when the pad according to the embodiment is used.

As illustrated in FIG. 6, portions of an abrasive surface of the abrasive disc 20 that are actually usable for grinding are an area Ax not supported by the supporting surface 11 and an area Ay that contacts the taper portion 14. The abrasive disc 20 has a certain amount of flexibility, and so, by tilting the shaft 2 toward the grinding target surface and bending the abrasive disc 20 at the outer edge 12, the user can grind using the area Ax without being obstructed by the nut 3. Further, the taper portion 14 inclines by an angle $\alpha$ with respect to the abrasive disc 20. Hence, by tilting the shaft 2 so that the taper portion 14 is parallel to the grinding target surface, the user can grind using the area Ay without being obstructed by the nut 3.

The lengths of areas Ax, Ay and Az along the radial direction can be freely selected. For instance, when a diameter of the abrasive disc 20 is from 80 to 120 mm, the lengths of each area may be set as follows. Specifically, upper and lower limits for a length of the area Ax may be 2 mm and 10 mm, respectively. Upper and lower limits for a length of the area Ay may be 12 mm and 20 mm, respectively. Upper and lower limits for a length of the area Az may be 25 mm and 35 mm, respectively. The angle $\alpha$ may also be freely selected. For example, the upper and lower limits of the angle $\alpha$ may be 10° and 30°, respectively.

As described above, according to this embodiment, the edge portion of the abrasive disc 20 protruding from the outer edge 12 of the supporting surface 11 is not supported by the pad 10. Thus, the protruding edge portion can be caused to contact the grinding target in a flexible manner. For example, the user can grind while continuously bending the edge portion. In addition, the supporting surface 11 has the taper portion 14 inclining in the manner described above toward the outer edge 12, with the abrasive disc 20 separating from the pad 10 in the taper portion 14. Hence, a portion of the abrasive disc 20 supported by the taper portion 14 can be caused to contact the grinding target in a flexible manner. Thus, the area Ay of the abrasive disc 20 supported by the taper portion 14 and an edge portion Ax can be effectively used for grinding. Consequently, the amount of abrasion with a single abrasive disc 20 is further increased and the lifetime of the abrasive disc 20 can be prolonged.

The pad 10 and the abrasive disc 20 are independent of each other. Thus, when the abrasive disc 20 is no longer usable, only the abrasive disc 20 needs to be replaced. Accordingly, resources can be conserved compared with products in which the pad and abrasive disc are integrated. Further, since there is a gap between the taper portion 14 and the abrasive disc 20, the user can finely adjust the force applied when causing the abrasive disc 20 to contact the grinding target surface.

As described above, the pad according to a first aspect of the present invention is a pad for supporting an abrasive disc by being fixed with the abrasive disc to a shaft of a grinder, the pad including a supporting surface that opposes the abrasive disc, wherein, in a radial direction, an outer edge of the supporting surface is located inward of an outer edge of the abrasive disc, and the supporting surface includes a taper portion inclined away from the abrasive disc as it approaches the outer edge of the supporting surface, and the abrasive disc is not fixed to the taper portion.

In such an aspect, the edge portion of the abrasive disc that projects beyond the outer edge of the supporting surface is not supported by the pad, and thus the protruding edge portion can be contacted against a grinding target in a flexible manner. In addition, the supporting surface of the pad includes the taper portion inclined in the manner described above toward the outer edge, and the abrasive disc separates from the pad in the taper portion. Hence, an area of the abrasive disc supported by the taper portion can be contacted against the grinding target in a flexible manner. Thus, the area of the abrasive disc supported by the taper portion and the edge portion can be effectively used for grinding and, consequently, the amount of abrasion with a single abrasive disc can be further increased.

In a pad according to another aspect, a curve projecting toward the abrasive disc side may be formed on the taper portion. Through provision of the curve, the abrasive disc supported by the pad can be caused to make a point contact with the grinding target surface. As a result, it is possible to specify the grinding location and adjust the grinding load in a favorable manner.

In the pad according to the other aspect, the cross-section of the supporting surface along the radial direction may have a V-shaped profile. Forming a pad in this manner allows the pad to be strengthened.

EXAMPLES

The present invention is described more specifically below based on working examples, but the present invention is not limited to the working examples.

As a working example, a pad corresponding to the above-described pad 10 was prepared. In the working example, a curve with a curvature radius of approximately 100 mm was formed on the taper portion of the pad. The lengths of the areas Ax and Ay along the radial direction were both set to approximately 21 mm. The angle $\alpha$ of the taper portion was from 18 to 20°.

Figure 7:
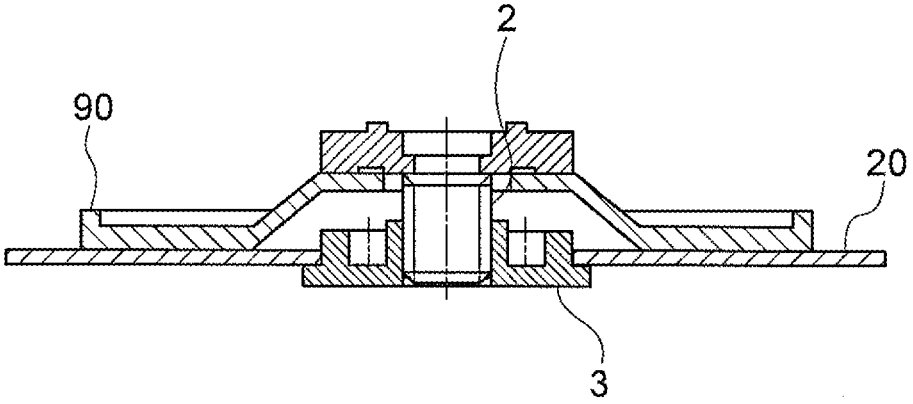
FIG. 7 is a cross-sectional view illustrating a configuration of a pad according to a comparative example.

In addition, a pad 90 with no taper portion, as illustrated in FIG. 7, was prepared as a comparative example. When using the pad 90, the user can only use a portion of the abrasive disc 20 protruding beyond the pad 90 (a portion corresponding to the area Ax in FIG. 6). In the comparative example, the portion corresponding to the area Ax was an outer circumferential portion with a width of 2 to 3 mm.

Besides the pad, the configuration of the grinder and the grinding target were common to both the working example and the comparative example. Specifically, for the main body of the portable grinder, the PAD10S (rotation speed: 12000 rpm) manufactured by Hitachi, Ltd. was used. For the abrasive disc, fiber disc 982C 60+(outer diameter: 4 inches) manufactured by 3M was used. For the grinding target, a flat plate made of austenitic stainless steel such as SUS304, was used. The grinding load applied by the operator to the grinder was from 1 kg to 5 kg.

Figure 8:
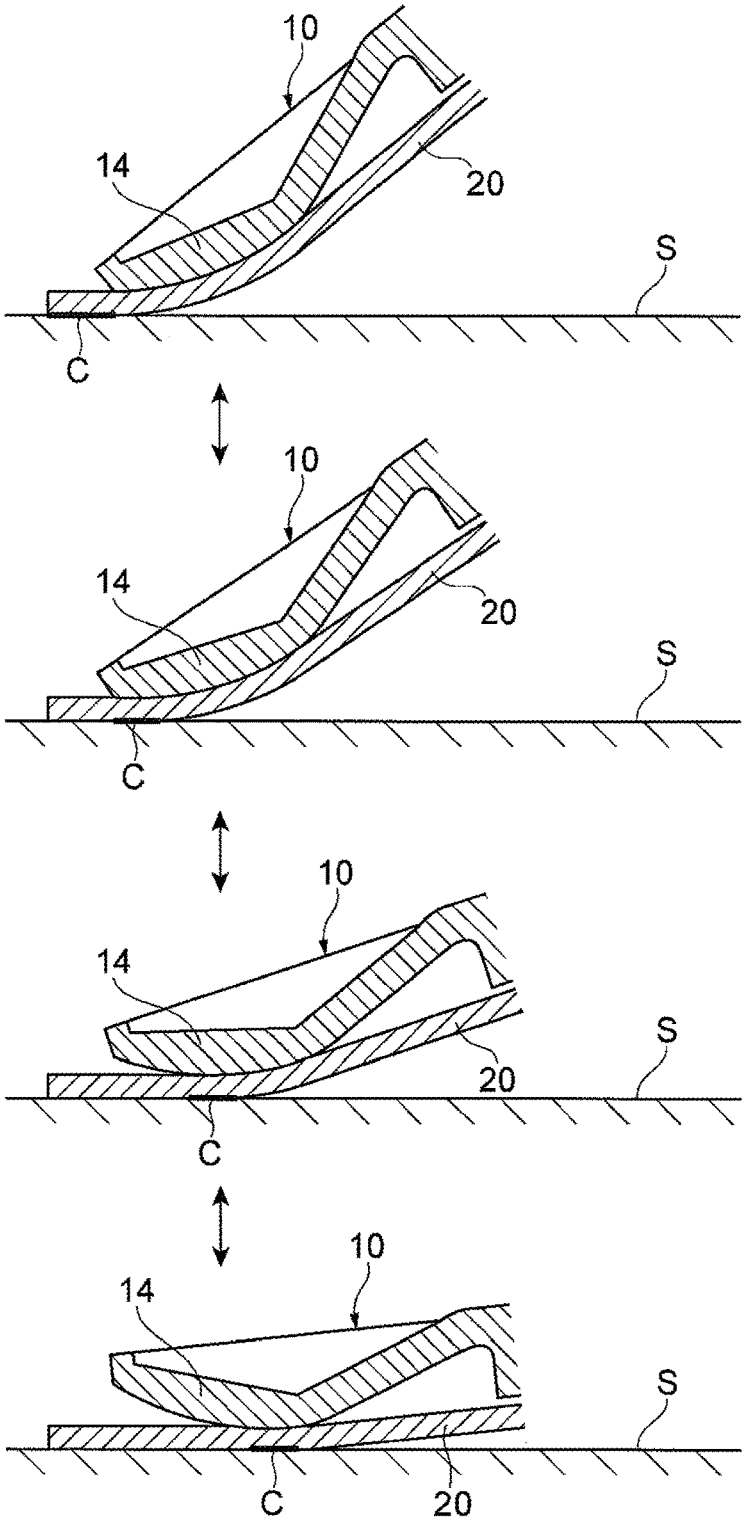
FIG. 8 is a view schematically illustrating modes of abrasion of the embodiment.

Next, the plates were ground using the portable grinder for both the working examples and comparative examples. At this time, the grinding was carried out while varying the position of the abrasive disc contacting the plate and the angles of the pad and abrasive disc with respect to the plate so as to fully use up a single abrasive disc. The modes of grinding in the working examples are illustrated in FIG. 8. In the working example, the taper portion 14 has a circumferential curve. Hence, a point C where the load is applied is varied within the above-described areas Ax and Ay by varying the angle of the pad 10 with respect to the grinding target surface S.

Figure 9:
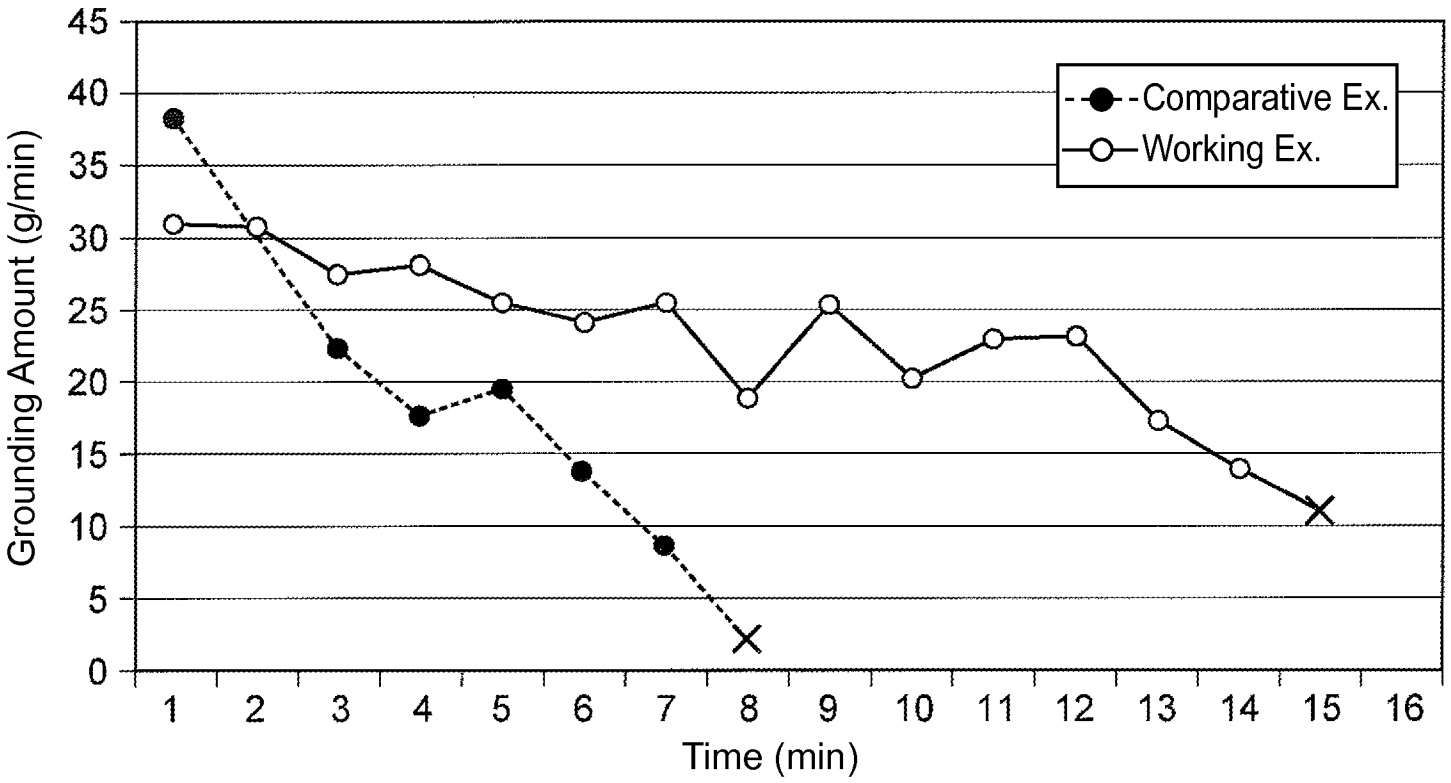
FIG. 9 is a graph showing abrasive amounts per minute for each of the embodiment and the comparative example.
Figure 10:
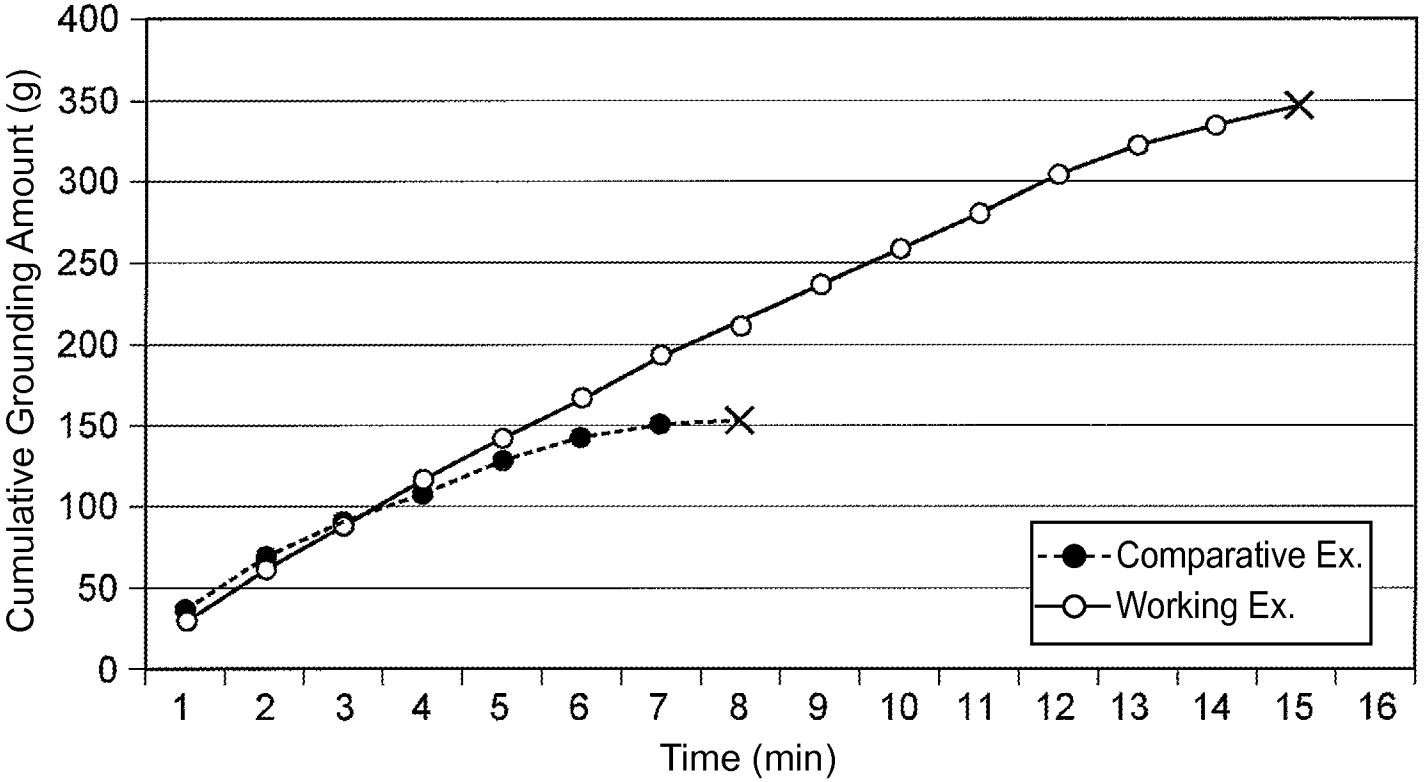
FIG. 10 is a graph showing cumulative abrasive amounts for each of the embodiment and the comparative example.

The change in the abrasive amount per minute in the grinding is shown in FIG. 9, and the cumulative amount of grinding from the start of grinding is shown in FIG. 10. The horizontal and vertical axes of the graph in FIG. 9 represent time elapsed since the start of grinding (min) and grinding amount per minute (g/min), respectively. The horizontal and vertical axes of the graph in FIG. 10 represent time elapsed since the start of grinding (min) and cumulative grinding amount (g), respectively. In both graphs, the solid line indicated the results of the working examples, and the dashed line indicates the results of the comparative examples. The x marks indicated the time at which grinding with the abrasive discs could no longer continue.

The present invention has been described in detail based on the embodiment. However, the present invention is not limited to the embodiment described above. Various modifications can be made to the present invention without deviating from the scope thereof.

Figure 11:
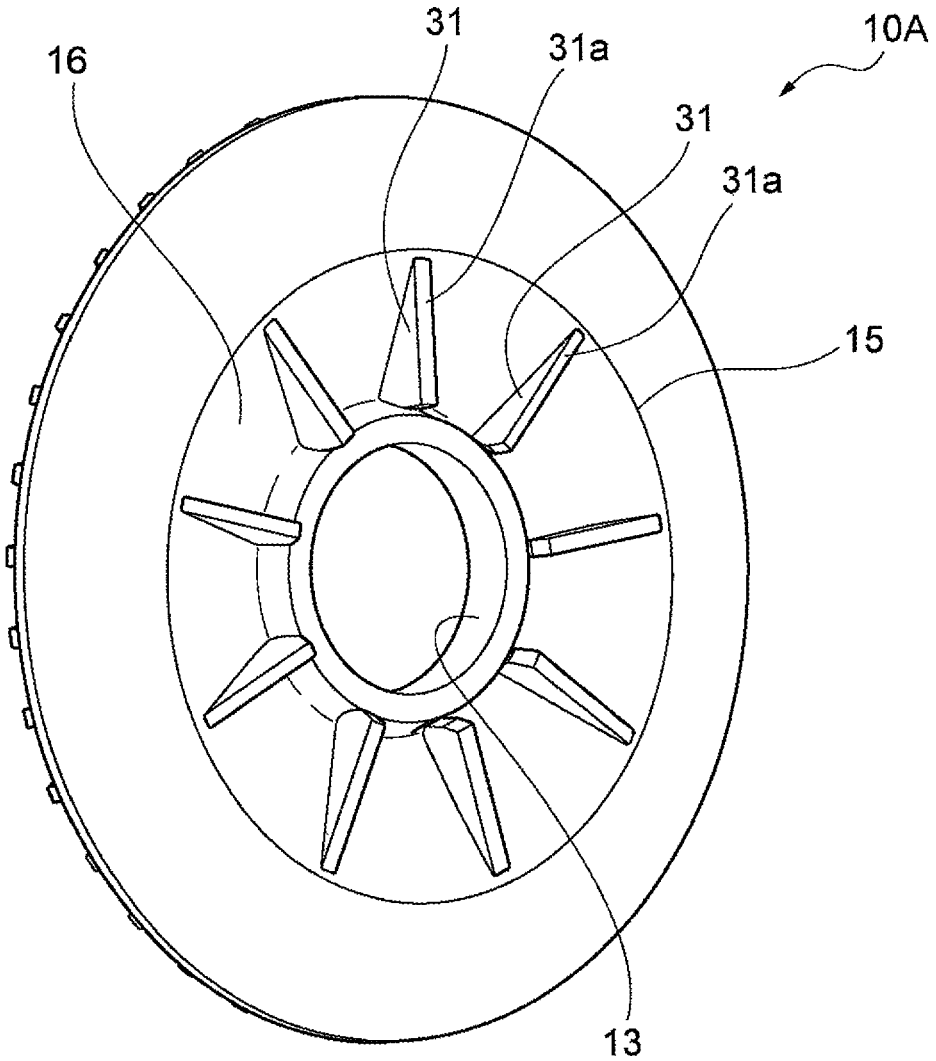
FIG. 11 is a perspective view illustrating a front surface of the pad according to a modified example.
Figure 12:
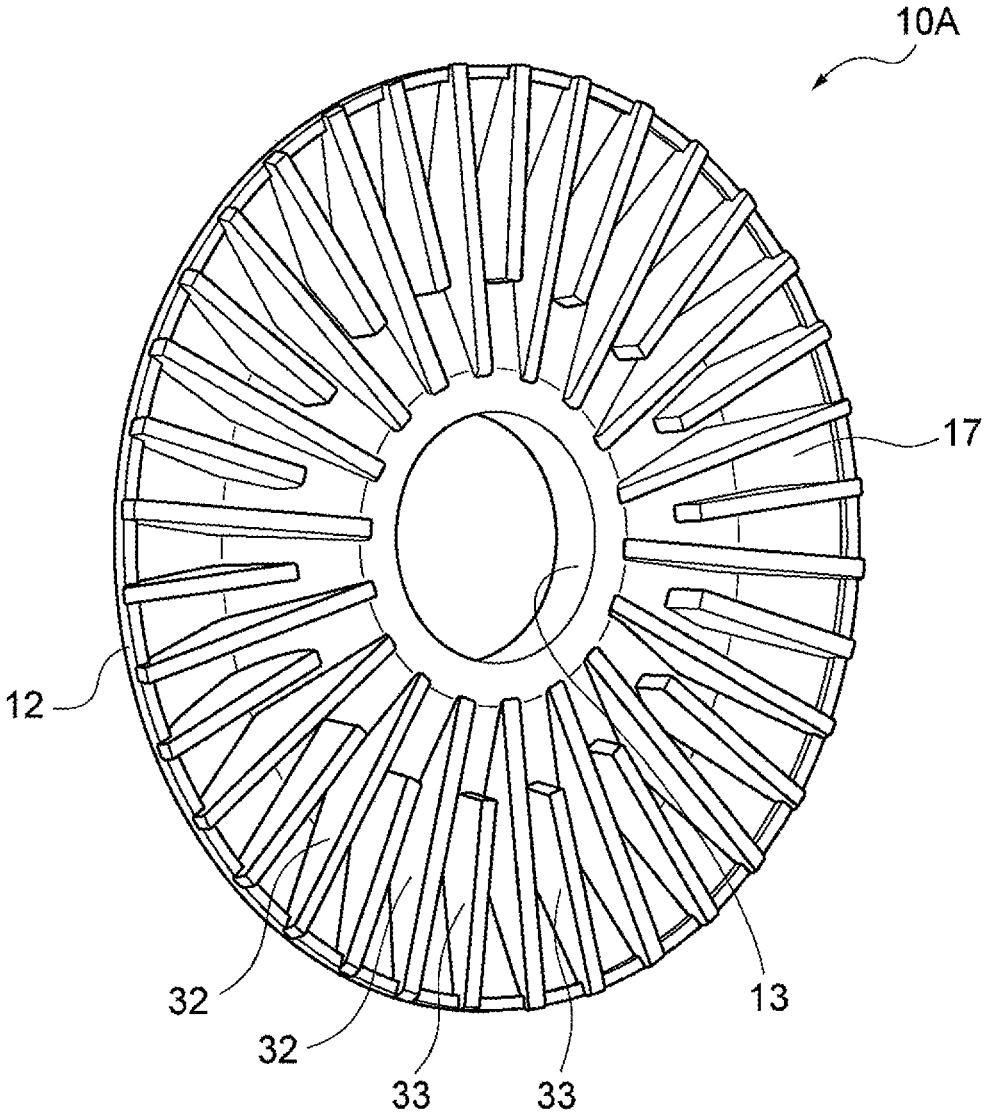
FIG. 12 is a perspective view illustrating a rear surface of the pad according to the modified example.

As illustrated in FIGS. 11 and 12, ribs may be provided on the front surface and the rear surface of the pad. The front surface of a pad 10A illustrated in FIG. 11 has a plurality of substantially equally spaced ribs 31 radially arranged along the circumferential direction of the depression 16. The ribs 31 are formed with a thin plate each having two sides along the depression 16 and a contact side 31*a* that extends from an edge of the through hole 13 to the vertex portion 15, and contacts the abrasive disc 20. Note that the number and spacing of the ribs 31 provided on areas other than the taper portion 14 is not limited to the example of FIG. 11, and may be freely set.

As illustrated in FIG. 12, a plurality of ribs 32 and ribs 33 are arranged alternately on the rear surface of the pad 1 OA radially along the circumferential direction of the recessed portion 17. The ribs 32 are formed from a thin plate each having two sides along the recessed portion 17 and a side that extends from an edge of the through hole 13 to the outer edge 12. The ribs 33, have a form similar to the ribs 32 except in that portions near the through hole 13 have been cut away. Note that the number and spacing of the ribs 32 and the ribs 33 are not limited to the example of FIG. 12, and may be freely set. Alternatively, the ribs 33 may be omitted.

Figure 13:
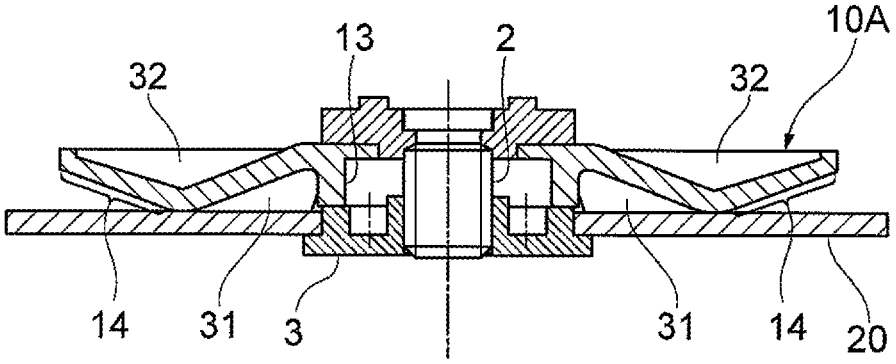
FIG. 13 is a cross-sectional view illustrating modes for supporting the abrasive disc at the front surface depicted in FIG. 11.
Figure 14:
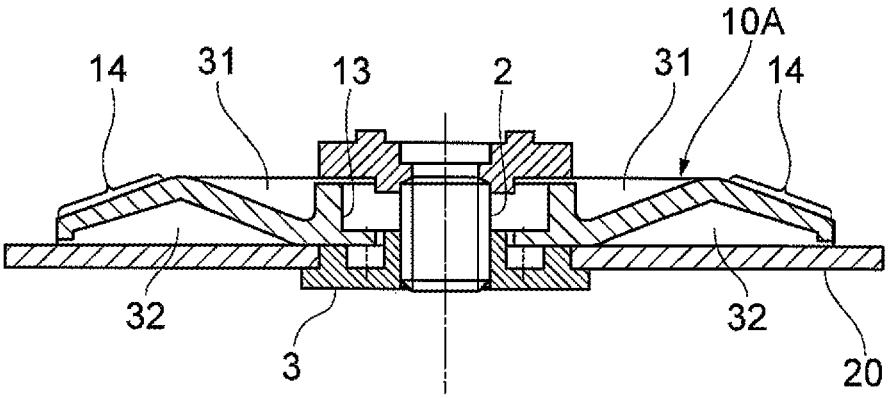
FIG. 14 is a cross-sectional view illustrating modes for supporting the abrasive disc at the rear surface depicted in FIG. 12.

With the pad 10A, the rear surface can also support the abrasive disc 20. As illustrated in FIGS. 13 and 14, the user can change the supporting surface of the abrasive disc 20 by changing the orientation of the pad 10A when installing the pad 10A on the shaft 2. FIG. 13 illustrates a state in which the front surface of the pad 10A faces the abrasive disc 20. Here, as in the above-described embodiments, the amount of grinding with a single abrasive disc can be further increased. On the other hand, FIG. 14 illustrates a state in which the rear surface of the pad 10A faces the abrasive disc 20. Here, the abrasive disc 20 is supported by the ribs 32 and 33 and so, as in the prior art, only an outer periphery portion of the abrasive disc can be used for grinding.

Figure 15:
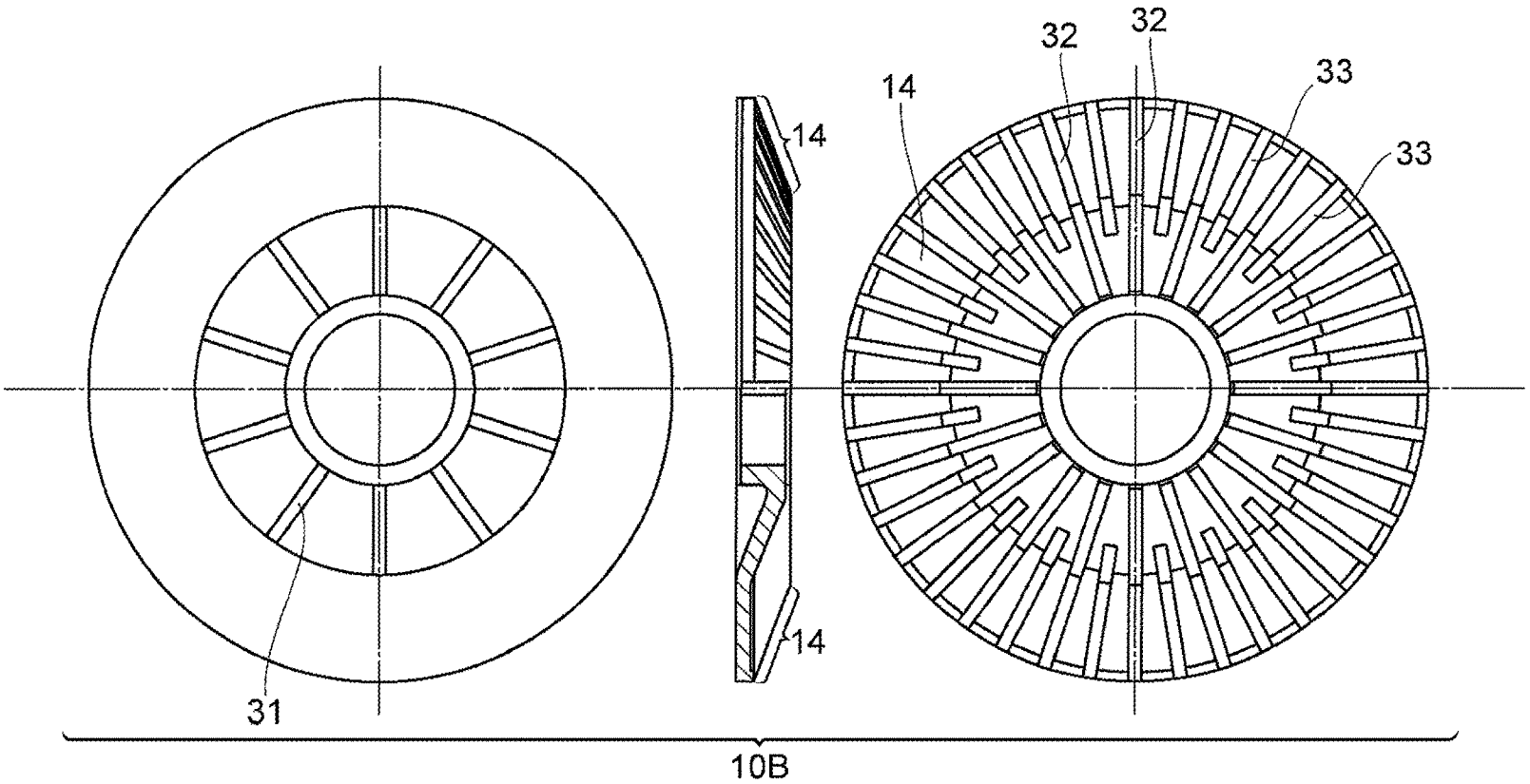
FIG. 15 is a view illustrating a configuration of a pad according to another modified example.

A further modified example of the pad 10A is illustrated in FIG. 15. In a pad 10B illustrated in FIG. 15, the ribs 32 and 33 are provided in the taper portion 14 of the front surface and ribs 31 are provided on the rear surface. As with pad 1 OA, the abrasive disc can be supported using both the front surface and the rear surface of the pad 10B.

Note that ribs may be provided on only one of either the front surface or the rear surface. In either case, providing ribs enables a reduction in the weight of the pad and saving pad materials while maintaining pad strength.

Thus, in the pad according to another aspect of the present invention, a plurality of ribs may be provided radially in the areas other than the taper portion of the supporting surface. Provision of ribs in this manner enables an increase in stiffness of the pad.

In the pad according to another aspect, a plurality of radial, latticed, columnar or similar form ribs may be provided on the surface on the side opposite the supporting surface. When the ribs form a plane, as illustrated in FIG. 14, the abrasive disc can also be supported using the rear surface of the pad.

In the above-described embodiments, the pad 10 has been described as being circular to match the form of the abrasive disc 20. However, the pad may take other forms. For example, the pad may be a dodecagon or other polygon with freely selected number of sides. Alternatively, a pad that is substantially circular with a wavy outer edge portion may be used. Moreover, the abrasive disc is not limited to being circular and may be a dodecagon or other polygon with freely selected number of sides. Alternatively, an abrasive disc that is substantially circular with a wavy outer edge portion may be used.

In the above described embodiments, a portable grinder was described as an example of a grinder, but the type of grinder is not limited. The pad according to the present invention can be applied in any grinder in which an abrasive disc is used.

What is claimed is:

1. A pad for supporting an abrasive disc by being fixed with the abrasive disc to a shaft of a grinder, the pad comprising:

a supporting surface configured to contact and engage the abrasive disc at a vertex portion, wherein a cross-section of the supporting surface along the radial direction has a V-shaped profile such that, when the grinder is not being operated, the abrasive disc contacts the supporting surface only at the vertex portion and portions of the abrasive disc located radially outward from the vertex portion are separated from the pad, in a radial direction, an outer edge of the supporting surface being located inward of an outer edge of the abrasive disc, the supporting surface including a taper portion extending from the vertex portion to the outer edge of the supporting surface, wherein the taper portion is inclined away from the abrasive disc as the taper portion approaches the outer edge of the supporting surface, and the abrasive disc being not fixed to the taper portion so as to be moveable relative thereto between a first position where the abrasive disc is separated from the taper portion and a second position where the abrasive disc contacts the taper portion.

2. The pad according to claim 1, wherein a plurality of ribs is provided in areas other than the taper portion.

3. The pad according to claim 1, wherein a plurality of ribs is provided radially on a face on a side opposite the supporting surface.

4. A circular backup pad for supporting a flexible circular abrasive disc, wherein the backup pad contains a central opening defining an inner edge, and wherein the backup pad has a V-shaped radial cross-sectional profile having an annular depression portion extending from the inner edge to a vertex portion that includes a supporting surface that contacts the abrasive disc such that, when a grinder to which the backup pad is attached is not being operated, the abrasive disc contacts the supporting surface only at the vertex portion and portions of the abrasive disc located radially outward from the vertex portion are separated from the backup pad;

wherein the annular depression portion includes the supporting surface sloped in a direction of the abrasive disc, and wherein the backup pad includes an annular taper portion extending from the vertex portion to an outer edge and the taper portion includes the supporting surface sloped away from the abrasive disc, wherein the abrasive disc is movable between an unflexed position wherein the supporting surface of the taper portion forms a gap with the abrasive disc that expands in a radial outward direction, and a flexed position wherein an outer portion of the abrasive disc is urged in a direction of the supporting surface of the taper portion.

5. The circular backup pad as defined in claim 4, wherein an abrasive disc outer edge extends radially outwardly beyond the backup pad outer edge in the flexed and unflexed positions.

6. An abrasive assembly comprising a backup pad and a flexible abrasive disc arranged to engage the backup pad, wherein the backup pad includes a supporting surface having a taper portion and an outer edge, and further wherein the flexible abrasive disc is repeatably movable between a first position wherein the flexible abrasive disc is generally planar and includes an outer peripheral region arranged in spaced relation with the taper portion of the supporting surface and a second position wherein the outer peripheral region of the flexible abrasive disc is flexed to contact the taper portion of the supporting surface;

wherein the backup pad has a V-shaped radial cross-sectional profile having an annular depression portion extending from an inner edge to a vertex portion that contacts the abrasive disc such that, when not being operated, the abrasive disc contacts the supporting surface only at the vertex portion and portions of the abrasive disc located radially outward from the vertex portion are separated from the backup pad.

7. An abrasive assembly as defined in claim 6, wherein when the abrasive disc is in its first position, a gap having an angle is formed between the abrasive disc and the taper portion of the supporting surface.

8. An abrasive assembly as defined in claim 7, wherein the angle of the gap is at least about 10 degrees and no greater than about 30 degrees.

9. An abrasive assembly as defined in claim 6, wherein when the abrasive disc is flexed to contact with the taper portion of the supporting surface, at least a portion of the outer peripheral region of the flexible abrasive disc extends beyond the outer edge of the supporting surface, whereby at least a portion of the outer peripheral region is not supported by the supporting surface.

10. The abrasive assembly as defined in claim 6, wherein the vertex portion is disposed radially inward of the taper portion and the outer edge, and wherein the taper portion extends from the vertex portion to the outer edge.

11. The abrasive assembly as defined in claim 6, wherein the abrasive disc is not fixed to the supporting surface.

12. The pad according to claim 1, wherein the abrasive disc is not fixed to the supporting surface.

13. A circular backup pad as defined in claim 4, wherein the abrasive disc is not fixed to the supporting surface.

* * * * *